US005205876A

United States Patent [19]

Sakai

[11] Patent Number: 5,205,876

[45] Date of Patent: Apr. 27, 1993

[54] ALLOYED TITANIUM ALUMINIDE HAVING LAMILLAR MICROSTRUCTURE

[75] Inventor: Kuniyasu Sakai, Kitamine, Japan

[73] Assignee: Taiyo Kogyo Co., Ltd., Tokyo, Japan

[21] Appl. No.: 870,860

[22] Filed: Apr. 20, 1992

[30] Foreign Application Priority Data

Dec. 6, 1991 [JP] Japan ..... 3-348666

[51] Int. Cl.[5] ..... C22C 14/00

[52] U.S. Cl. ..... 148/421; 420/418; 420/421

[58] Field of Search ..... 148/421; 420/418, 421

[56] References Cited

U.S. PATENT DOCUMENTS 4,849,168 7/1989 Nishiyama et al. ..... 420/418

FOREIGN PATENT DOCUMENTS 0455005 6/1991 European Pat. Off. .

0469525 2/1992 European Pat. Off. .

91096697 7/1991 World Int. Prop. O. .

*Primary Examiner*—Upendra Roy

*Attorney, Agent, or Firm*—Lowe, Price, LeBlanc & Becker

[57] ABSTRACT

A titanium/aluminum alloy having a lamellar structure, comprising 0.01 to 0.05 wt. % of carbon, 31 to 35 wt. % of aluminum, 0.5 to 2.5 wt. % of manganese, 0.01 to 0.3 wt. % of nickel, 0.01 to 0.03 wt. % of cobalt, 0.05 to 0.2 wt. % of tungsten, 0 to 0.02 wt. % of magnesium, 0.01 to 0.05 wt. % of gold, 0.03 to 0.06 wt. % of boron, 0.04 to 0.08 wt. % of iron, and the balance of titanium.

1 Claim, No Drawings

ALLOYED TITANIUM ALUMINIDE HAVING LAMILLAR MICROSTRUCTURE

BACKGROUND OF THE INVENTION

The present invention relates to a titanium/aluminum alloy suitable as material for members which are required to be resistant to heat at high temperatures (500 to 700° C.) and medium temperatures, high in proof stress, and long in fatigue life such as compressor blades, spacers, etc. of gas turbines.

Conventionally, titanium/aluminum base alloys are known as brittle material although they have a proof stress of about 35 Kgf/mm$^2$.

The above proof stress value remains until the alloys are heated to about 800° C. and although the alloys exhibit a breaking extension of about 15% or over at high temperatures, when they are broken, cleavage planes are observed in many places on the broken surface, which is characteristic of unstable breakage.

A titanium/aluminum alloy made up of 50 to 63 wt. % of titanium, 5 to 50 wt. % of aluminum, 0.02 to 0.1 wt. % of boron, and other materials is suggested in Japanese Patent Application Laid-Open No. 61017/1990. Further, Japanese Patent Application No. 80661/1991 suggests a titanium/aluminum alloy made up of 50 to 65 wt. % of titanium, 35 to 50 wt. % of aluminum, 0.02 to 0.1 wt. % of boron. and other material wherein long $\alpha^2$-$\gamma$ layers are arranged in one direction.

SUMMARY OF THE INVENTION

A first object of the present invention is to provide a titanium/aluminum alloy having a lamellar structure which has quite many advantages, can be produced industrially, and is metallurgically stable even when it is allowed to stand at a high temperature of about 1000° C. (in a vacuum).

A second object of the present invention is to provide a titanium/aluminum alloy which has superbly excellent properties in addition to such properties that when it is allowed to stand under high temperatures for a long period of time, the high proof stress, the high ductility, the long fatigue life, the good heat resistance, and the production reproducibility are kept and which is suitable as structural material for compressor blades, spacers, and related parts of gas turbines wherein the above properties are required at high temperatures and medium temperatures.

In order to attain the above objects, the present invention has added to a titanium/aluminum alloy, in addition to the above components, specified amounts of carbon, manganese, nickel, cobalt, tungsten, magnesium, gold, boron, and iron.

DETAILED DESCRIPTION OF A PREFERRED MODE OF THE INVENTION

The present alloy is a titanium/aluminum alloy made up of 0.01 to 0.05 wt. % of carbon, 31 to 35 wt. % of aluminum, 0.5 to 2.5 wt. % of manganese, 0.01 to 0.3 wt. % of nickel, 0.01 to 0.03 wt. % of cobalt, 0.05 to 0.2 wt. % of tungsten, 0 to 0.02 wt. % of magnesium, 0.01 to 0.05 wt. % of gold, 0.03 to 0.06 wt. % of boron, 0.04 to 0.08 wt. % of iron, and the balance of titanium.

More advantageously, in the above alloy, the amount of carbon is about 0.02 wt. %, the amount of aluminum is about 34 wt. %, the amount of manganese is about 1 wt. %, the amount of nickel plus cobalt is about 0.03 wt. %, the amount of gold is about 0.02 %, and the amount of boron is about 0.04 wt. %. The above alloy is resistant to heat at a temperature 200° C. higher than that at which conventional heat resistant titanium alloy can resist and also the above alloy has a property that the fatigue life can be kept long even when a load corresponding to a 0.02% proof stress is applied to a structure of the cast alloy itself repeatedly.

For gas turbines for airplanes, light-weight parts are required which can be practically used under a high temperature and a medium temperature and a high stress, in fact about half of the overall weight of a gas turbine is due to a multicomponent alloy (having a specific gravity of about 8) such as a high-nickel hard metal, and it is being attempted that the multicomponent alloy is replaced with a light-weight alloy (having a specific gravity of 4 or less) as far as possible.

Although the present titanium/aluminum alloy having a lamellar structure requires skill to produce it, the cast item itself has a heat resistance, a ductility, a high proof stress, and a long fatigue life which are at practical levels and the specific strength and the fatigue limit strength ratio (about 0.8) at high and medium temperatures are far more excellent than those of hard metals. In addition, its properties including the ductility, the high proof stress, the fatigue life, and the high Young's modulus in a vacuum under a high temperature (of 800 to 1,000° C.) are not inferior to those of hard metals.

The present alloy which has the advantages mentioned above and possesses properties of a material to be used in from a high temperature range to a medium temperature range is excellent in properties superior to fatigue life properties of all other heat resistant titanium alloys and can be used in practice immediately.

The allowed amounts of components in the present alloy interrelate with the other components.

If the amount of carbon is less than 0.01 wt. %, the alloy is apt to bend whereas if the amount of carbon exceeds 0.05 wt. %, the carbide (TiC) makes the alloy brittle. The aluminum is the major component composing the T; Al phase and if the amount of aluminum is less than 31 wt. %, the T; 3 Al phase appears greatly thereby lowering the strength at a high temperature whereas if the the amount of aluminum exceeds 35 wt. %, the T; 3 Al phase becomes extremely decreases, therefore the formation of the T; Al/T; 3 Al lamellar structure becomes difficult, and the resulting alloy becomes like conventional titanium/aluminum alloys without reinforcing layers and the properties become poor. If the amount of manganese is less than 0.5 wt. %, cleavage breakages appear in the lamellar structure thereby lowering the strength whereas if the amount of manganese is exceeds 2.5 wt.%, the ductility lowers. If the amounts of the nickel, cobalt, and tungsten are too smaller than the critical values, the reinforcement between the lamellar structures lowers, leading to a decrease in the strength. If their amounts exceed the critical values, although the creep strength increases, localized structures appear and the mechanical properties are adversely influenced. If the amounts of boron and gold are too smaller than the critical values, the ductility is impaired whereas if the amounts are too large, the ductility becomes unfavorable and the strength lowers.

When the present titanium/aluminum alloy having a lamellar structure is cast to have a desired lamellar structure for a gas turbine structural material for airplanes, a part can be obtained which is characterized by very excellent properties such as good heat resistance, ductility, high proof stress, and long fatigue life which change little even it is allowed to stand under a high temperature for a long period of time.

EXAMPLES

Example 1 of examples of titanium/aluminum base alloy having a lamellar structure is made up of 0.02 wt. % of carbon, 32 wt. % of aluminum, 1 wt. % of manganese, 0.03 wt. % of nickel plus cobalt, 0.1 wt. % of tungsten, 0.02 wt. % of magnesium, 0.01 wt. % of gold, 0.04 wt. % of boron, 0.04 wt. % of iron, and the balance of titanium. When this alloy is cast as a structural material of a gas turbine for airplanes, a cast item characterized by combined properties of reproducibility of the properties of the product, good heat resistance at high and medium temperatures, high proof stress, ductility, long fatigue life, etc. can be obtained.

Experimental results obtained on the basis of this typical example indicate usefulness regarding many mechanical properties.

The experimental results were obtained from samples cut from a product made only by centrifugal precision casting.

The low-cycle rupture life under a repeated loading of 64 Kgf/mm$^2$ at 700° C. and a stress ratio R of 0.1 indicated $2\times10^5$ cycles or over and the low-cycle rupture life under a repeated loading of 68 Kgf/mm$^2$ at room temperature indicated a far more longer life. The high-cycle rupture life under a repeated loading of 10 HZ and 68 Kgf/mm$^2$ at the same temperature indicated $2\times10^7$ cycles or over, which indicates the alloy can withstand if it is allowed to stand for 500 hours under heating. This is, a fact has been found that if it is allowed to stand for a long period of time under heating, the long fatigue life, the mechanical properties, etc. are not influenced relatively under a repeated loading of about 0.02% proof stress.

Table 1 shows the results of tensile tests at room temperature to 1,000° C. regarding the alloy of above Example.

TABLE 1

| | Room temperature | 400° C. | 600° C. | 800° C. | 1,000° C. |
|---|---|---|---|---|---|
| Tensile strength (Kgf/mm$^2$) | 78.0 | 83.3 | 88.2 | 106.0 | 58.3 |
| 0.2% proof stress (Kgf/mm$^2$) | 73.7 | 73.9 | 77.6 | 80.3 | 39.6 |
| 0.02% proof stress (Kgf/mm$^2$) | 67.8 | 65.8 | 66.2 | 58.3 | 29.2 |
| Extension (%) | 2.5 | 3.2 | 4.1 | 8.7 | 14.4 |

This alloy is resistant to heat and is characterized in that the data reproducibility under high temperatures is excellent.

Compositions of alloys of Examples 2, 3, and 4 of examples of the present invention are shown in weight percents in Table 2.

TABLE 2

| Element | Example 2 | Example 3 | Example 4 |
|---|---|---|---|
| C | 0.02 | 0.02 | 0.04 |
| Al | 32.0 | 33.4 | 34.7 |
| Mn | 1.0 | 1.12 | 2.3 |
| Ni + Co | 0.03 | 0.03 | 0.05 |
| W | 0.06 | 0.07 | 0.18 |
| Mg | 0.02 | 0.02 | 0.01 |
| Au | 0.01 | 0.02 | 0.01 |
| B | 0.03 | 0.04 | 0.05 |
| Fe | 0.01 | 0.03 | 0.07 |
| Ti | the balance | the balance | the balance |

The present alloy can be cast by plasma arc melting by using the centrifugal precision casting process under a high vacuum. The effectiveness of the casting process is exhibited in the solidification structure and the alloy can be cast into a desired precision cast item comprising only long lamellar structures.

The titanium constituting the balance may contain small amounts of impurities and accompanying elements. However, these impurities and accompanying elements should be kept low enough to be practical by taking the requirements for the production into consideration.

The present alloy is suitable for casting gas turbine structural materials such as compressor blades, spacers and the related parts and is used effectively in the field where high strength is required under high temperatures.

Thus the present invention has been described with reference to effective Examples but it must be understood that modifications and applications which will be made without departing from the spirit of the invention and its technical range are included in the present technical range.

What is claimed is:

1. A titanium/aluminum alloy having a lamellar structure, comprising 0.01 to 0.05 wt. % of carbon, 31 to 35 wt. % of aluminum, 0.5 to 2.5 wt. % of manganese, 0.01 to 0.3 wt. % of nickel, 0.01 to 0.03 wt. % of cobalt, 0.05 to 0.2 wt. % of tungsten, 0 to 0.02 wt. % of magnesium, 0.01 to 0.05 wt. % of gold, 0.03 to 0.06 wt. % of boron, 0.04 to 0.08 wt. % of iron, and the balance of titanium.

* * * * *